US007097172B2

(12) United States Patent
Chang

(10) Patent No.: US 7,097,172 B2
(45) Date of Patent: Aug. 29, 2006

(54) PAPER FEEDING CASSETTE TO LOAD PAPER OF VARIOUS SIZES

(75) Inventor: Won-kil Chang, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 232 days.

(21) Appl. No.: 10/430,255

(22) Filed: May 7, 2003

(65) Prior Publication Data

US 2003/0227127 A1 Dec. 11, 2003

(30) Foreign Application Priority Data

Jun. 5, 2002 (KR) ..... 2002-31765

(51) Int. Cl.
*B65H 1/00* (2006.01)

(52) U.S. Cl. ..... 271/171; 271/145

(58) Field of Classification Search ..... 271/171, 271/144, 223, 157

See application file for complete search history.

(56) References Cited

U.S. PATENT DOCUMENTS 5,630,630 A * 5/1997 Price et al. ..... 292/128

FOREIGN PATENT DOCUMENTS

JP 2-279729 11/1990
JP 10-152235 6/1998

OTHER PUBLICATIONS

Japanese Office Action dated Sep. 14, 2004.

* cited by examiner

*Primary Examiner*—Eileen D. Lillis
*Assistant Examiner*—Kaitlin Joerger
(74) *Attorney, Agent, or Firm*—Staas & Halsey LLP

(57) ABSTRACT

A paper feeding cassette includes a frame provided with a bottom plate to support paper and a plurality of walls to define a paper loading size. The paper feeding cassette also includes a loading size adjustment device to pivotally connect at least one of the walls to be hinged on the bottom plate, so that the at least one wall is movable between a vertical position to limit the paper loading size, and a horizontal position to not limit the paper loading size, enabling a variation of the paper loading size. Since the loading size of the paper feeding cassette is varied in accordance with a size of papers to be used, papers of various sizes may be used without having to increase a size of the cassette and an office machine which uses the cassette.

28 Claims, 4 Drawing Sheets

PAPER FEEDING CASSETTE TO LOAD PAPER OF VARIOUS SIZES

CROSS REFERENCE TO RELATED APPLICATION

This application claims the benefit of Korean Application No. 2002-31765, filed Jun. 5, 2002, in the Korean Intellectual Property Office, the disclosure of which is incorporated herein by reference.

BACKGROUND OF THE INVENTION

1. Field of the Invention

The present invention relates to a paper feeding cassette for use in an office machine such as a printer, copy machine and facsimile machine, and more particularly, to a paper feeding cassette capable of varying paper loading size in accordance with a size a of paper being used.

2. Description of the Related Art

In general, an office machine such as a printer, copy machine, and facsimile machine is provided with a paper feeding tray or cassette (hereinafter, to be referred as "paper feeding cassette") to load a number of papers. The paper feeding cassette is classified into an exclusive cassette of a fixed size, and a universal cassette of an adjustable size to load paper of different sizes and to freely use the papers irrespective of their sizes.

Because it has a fixed paper loading size intended only for one size paper, the exclusive cassette has an advantage of ensuring that the paper of a desired size is fed. However, the exclusive cassette has a disadvantage in that the cassette needs to be replaced with another exclusive cassette of a different size for a printing operation that uses a paper of a size other than the exclusive cassette initially used. Furthermore, in order to use papers of different sizes, it is necessary to prepare various sizes of paper feeding cassettes to be used exclusively for a corresponding paper size. Therefore, a number of paper feeding cassettes are needed and thus, a space to separately house the paper feeding cassettes may be required.

To overcome the above-described disadvantages of the exclusive cassette, universal cassettes capable of using plural sizes of papers have recently been used.

Referring to FIG. 1, there is shown conventional universal paper feeding cassette which is designed to allow a user to adjust the cassette to meet various sizes of papers by moving one or more side guide members and/or a rear guide member to load the various sizes of papers into the cassette.

The conventional universal paper feeding cassette 1 includes a frame 10 within which one or more papers are loaded, left and right side guide members 20 and 20' which are located at front opposite sides of the frame 10 to slide crosswise of the papers loaded in the frame 10 while supporting lateral edges of the papers loaded in the frame 10, and a rear guide member 30 which is located at a rear center of the frame 10 to slide lengthwise of the papers loaded in the frame 10 while supporting rear edges of the papers.

The universal cassette 1 is capable of loading papers of different sizes by adjusting the left guide member 20 and the rear guide member 30.

However, because universal cassettes are limited in that the universal cassettes are manufactured in a predetermined range of sizes to increase a loading rate or capacity of office machines during shipping, the universal cassettes may be loaded for papers having a limited size range. Thus, for example, the papers may not exceed A3 size (420×297 mm) and may be adjusted only within the predetermined range of sizes.

Therefore, when papers exceed the A3 size (for example, when Super-A3 size (445×297 mm) papers are required to be printed), there is an inconvenience in that the papers need to be loaded in an abnormal manner or the printing is performed by using a separate exclusive cassette.

SUMMARY OF THE INVENTION

Accordingly, it is an aspect of the present invention to provide a paper feeding cassette capable of varying paper loading size according to a size of paper to be used, so as to use papers of various sizes without having to increase a size of the cassette or an office machine that uses the cassette.

Additional aspects and advantages of the invention will be set forth in part in the description which follows and, in part, will be obvious from the description, or may be learned by practice of the invention.

The foregoing and/or other aspects of the present invention are achieved by providing a paper feeding cassette including a frame provided with a bottom plate to support one or more papers and a plurality of walls to define a paper loading size, a loading size adjustment device to pivotally connect at least one of the walls and to be hinged on the bottom plate, so that the at least one wall is movable between a vertical position to limit the paper loading size, and a horizontal position to not limit the paper loading size, enabling a variation of the paper loading size.

According to an aspect of the invention, the loading size adjustment device includes at least one locking part to lock at least one wall to the vertical position when the at least one wall is moved to the vertical position, and at least one hinge part which supports the at least one wall so that the at least one wall is pivoted between the vertical position and the horizontal position.

According to an aspect of the invention, the locking part includes at least one hook member which is formed on at least one of one end and the other end of a portion of the at least one wall, at least one hook member locking groove which is formed on at least one of portions of the neighboring walls positioned adjacent to the at least one wall to correspond to the hook member, and a hook member actuating part to lock the hook member to the hook member locking groove and to release the hook member from the locking groove.

According to another aspect of the invention, the hook member actuating part includes a supporting member to pivotally support the hook member on the at least one wall, so that the hook member is moved between a locking position to lock the hook member in the hook member locking groove and a releasing position to release the hook member from the hook member locking groove. The hook member actuating part also includes an actuating member to actuate the supporting member to allow the hook member to be moved to the releasing position, and a return member to elastically urge the actuating member to allow the hook member to be returned to the locking position.

According to another aspect of the invention, the supporting member includes a shaft which pivotally supports the hook member on the at least one wall so that the hook member moves between the locking position and the releasing position.

According to yet another aspect of the invention, the actuating member includes a projection part which is provided on the shaft and radially projects, and an actuating button which is provided on the at least one wall, so that the actuating button comes into contact with the projection part to move the hook member to the releasing position.

According to another aspect of the invention, the return member includes an elastic spring which is positioned to elastically compress the projection part to rotate the shaft through the projection part, so that the hook member is returned to the locking position.

According to yet another aspect of the invention, the hinge part includes at least one hinge shaft member provided in at least one of other portions of the neighboring walls adjacent to the at least one wall, and at least one receiving part formed in at least one of one end and the other end of other portions of the at least one wall to rotatably support the hinge shaft member.

According to an aspect of the invention, the hinge shaft member includes a stationary bracket which is fixed on the other portion of at least one of the neighboring walls to project toward the other portion of the at least one wall, and a shaft which is fixed on an end of the stationary bracket to pivotally support the other portion of the at least one wall. The shaft includes a roller so that at least one wall is smoothly rotated. The receiving part includes a shaft receiving groove to rotatably receive the shaft in the other portion of the at least one wall.

According to another aspect of the present invention, the at least one wall is an end wall which defines a lengthwise loading size of the papers and the neighboring walls are side walls which define a crosswise loading size of the papers.

According to an aspect of the invention, the paper feeding cassette includes a rear guide member to guide and set rear edges of the papers, and the end wall includes an auxiliary moving guide rail which is connected to a moving guide rail formed on the bottom plate, so that the rear guide member is moved onto the end wall when the end wall is pivoted to the horizontal position.

BRIEF DESCRIPTION OF THE DRAWINGS

The above and/or other aspects and advantages of the present invention will become apparent and more appreciated from the following detailed description of the preferred embodiments, taken in conjunction with the accompanying drawings of which.

DETAILED DESCRIPTION OF THE PREFERRED EMBODIMENT

Figure 1:
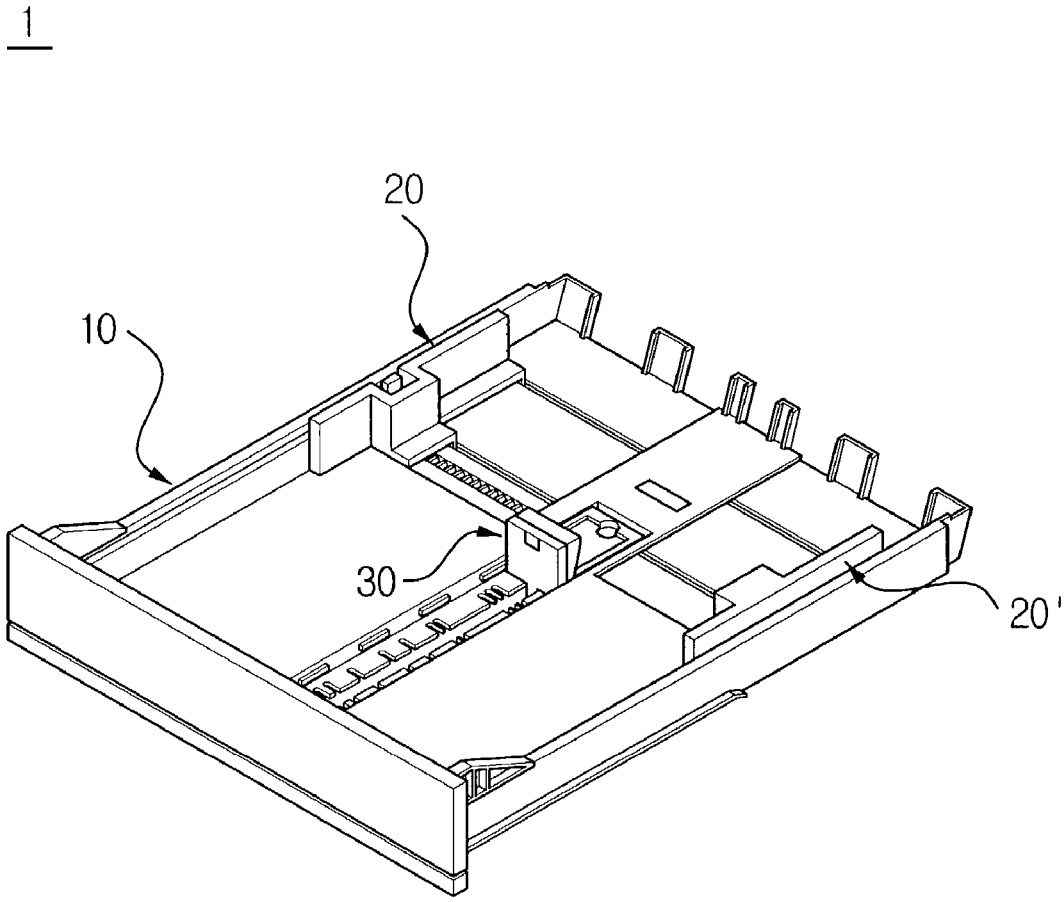
FIG. 1 (PRIOR ART)
FIG. 1 is a perspective view of a conventional paper feeding cassette.

Reference will now be made in detail to the present preferred embodiments of the present invention, examples of which are illustrated in the accompanying drawings, wherein like reference numerals refer to like elements throughout.

Figure 2:
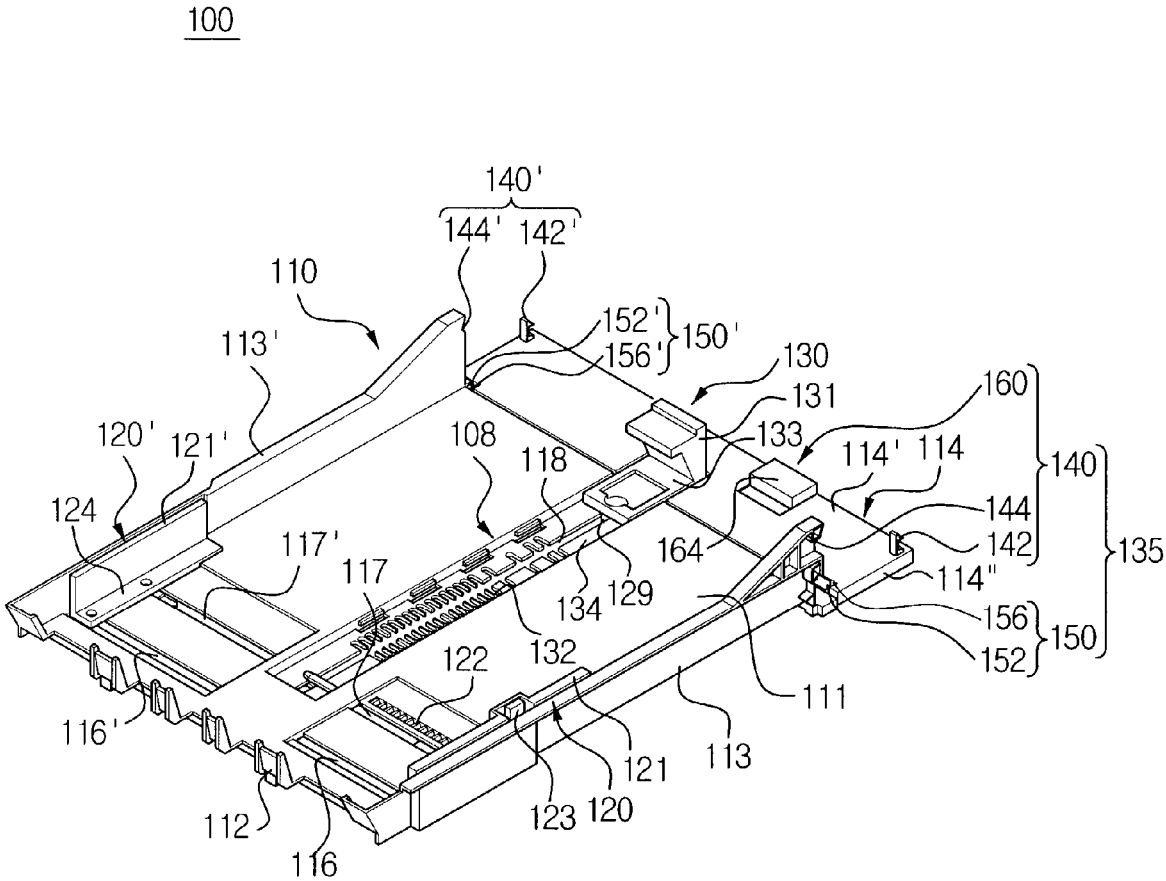
FIG. 2 is a perspective view of a paper feeding cassette, according to an embodiment of the present invention, in which an end wall is located in a horizontal position where a paper loading size is not limited.

Referring to FIG. 2, there is illustrated a paper feeding cassette 100, according to an embodiment of the present invention.

The paper feeding cassette 100 includes a frame 110 within which paper sheets are loaded, left and right side guide members 120 and 120' which are located at front opposite sides of the frame 110 to slide crosswise of the paper sheets loaded in the frame 110 while supporting opposite lateral edges of the paper sheets loaded in the frame 110. The paper feeding cassette 100 also includes a rear guide member 130 located at a center of the frame 110 to slide lengthwise of the papers loaded in the frame 110 while supporting rear edges of the paper sheets.

The frame 110 includes a bottom plate 111 to support the paper sheets, a tip end 112 which is to be mounted into a paper feeding section of an office machine (not shown), side walls 113 and 113' which define a crosswise loading size of the paper sheets, and an end wall 114 which defines a lengthwise loading size of the paper sheets.

The left side (right side of FIG. 2) guide member 120 includes first slide projections (not shown) which are respectively inserted into first guide holes 116 and 117. The first guide holes 116 and 117 are spaced at a predetermined distance and formed on a front left side of the frame 110 in a crosswise direction. The left side guide member 120 also includes a first latch section 122 having a plurality of latches formed on the bottom plate 111 of the frame 110, and a first latch (not shown) which is formed on a lower side of a bottom part (not shown) of the left side guide member 120 to engage with the first latch section 122, thereby locking the left side guide member 120 to the frame 110. A body 121 of the left side guide member 120, which is located adjacent to the bottom part formed with the first latch, is provided with a knob 123 to release an engagement between the first latch on the bottom part and the first latch section 122 by lifting the bottom part formed with the first latch, so that the left side guide member 120 locked to the frame 110 by the engagement between the first latch section 122 and the first latch is allowed to move.

The right side guide member 120' is used as a reference surface to set one or more papers without being moved, except for a case where a special-sized paper such as an envelope is printed. Likewise, the right side guide member 120' is the same as the left side guide member 120, except that no latch is formed on a lower side of a bottom part 124 of the right side guide member 120' to lock the right side guide member 120' in a moved position. Thus, the right side guide member 120' includes slide projections (not shown) which are inserted into guide holes 116' and 117' formed on a front right side of the frame 110 to allow a body 121' of the right side guide member 120' to move in the crosswise direction.

As no latch is formed on the lower side of the bottom part 124 of the right side guide member 120', a front right side of the bottom plate 111 of the frame 110 is not formed with a latch section.

The rear guide member 130 includes a body 131, and a bottom part 133. The bottom part 133 has a second slide projection 129 which is inserted into a guide hole 118 of a moving guide rail 108 as described later formed on a center of the bottom plate 111 of the frame 110 in the lengthwise direction of the papers, so that the second slide projection 129 movably secures the rear guide member 130 to the frame 110, and a latch or a projection (not shown) which is formed on a lower side of a bottom part 133 of the rear guide member 130 to engage with a latch groove 132 as described later, thereby locking the rear guide member 130 to the frame 110.

The paper feeding cassette 100 includes a loading size adjustment mechanism 135 which pivotally connects the end wall 114 to the opposite side walls 113 and 113', so that the end wall is moved between a vertical position in which the lengthwise loading size of the paper sheets is limited and a horizontal position in which the lengthwise loading size of the paper sheets is not limited to allow varying of the lengthwise loading size.

The loading size adjustment mechanism 135 includes locking parts 140 and 140' to lock the end wall 114 in the vertical position when the end wall 114 is moved to the vertical position, and hinge parts 150 and 150', which support the end wall 114 so that the end wall 114 is pivotable between the vertical position and the horizontal position.

The locking parts 140 and 140' include hook members 142 and 142' formed on left and right sides of an upper portion of the end wall 114, respectively, hook member locking grooves 144 and 144' formed on upper portions of the opposite side walls 113 and 113' adjacent to the end wall 114, respectively, to correspond to the hook members 142 and 142', and a hook member actuating part 160 located in a space formed between front and rear plates 114' and 114" of the end wall 114 to lock the hook members 142 and 142' to the hook member locking grooves 144 and 144' and to release the hook members 142 and 142' from the locking grooves 144 and 144'.

Figure 3:
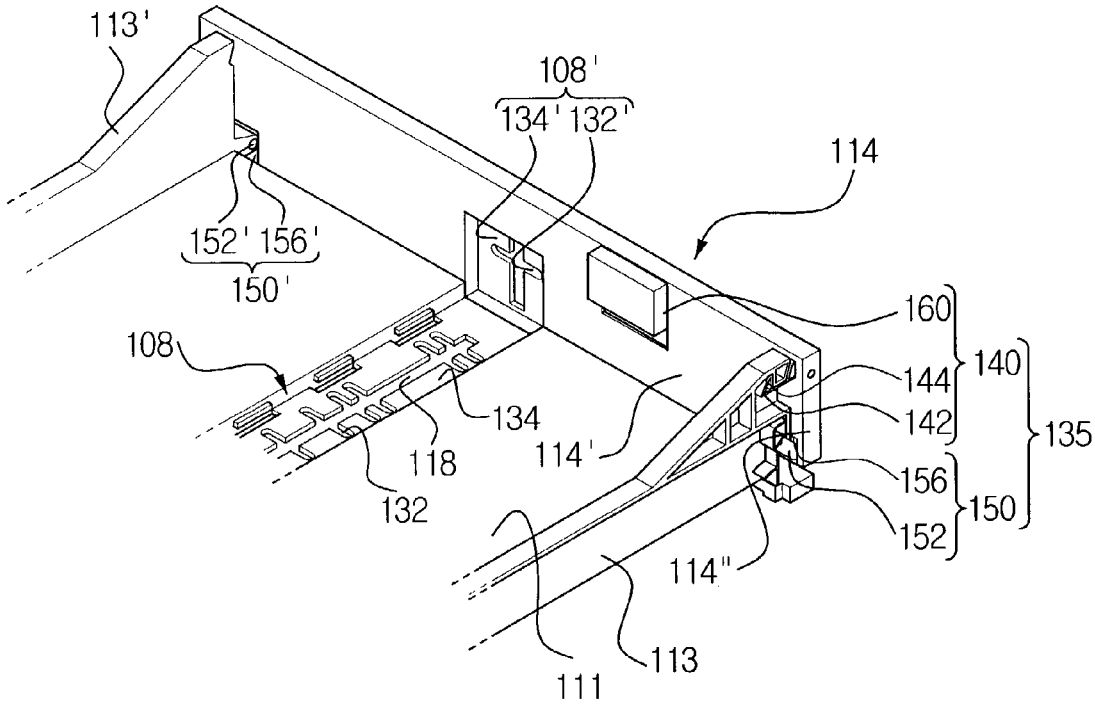
FIG. 3 is a partial perspective view of the paper feeding cassette shown in FIG. 2, in which the end wall is located in a vertical position where a paper loading size is limited.
Figure 4:
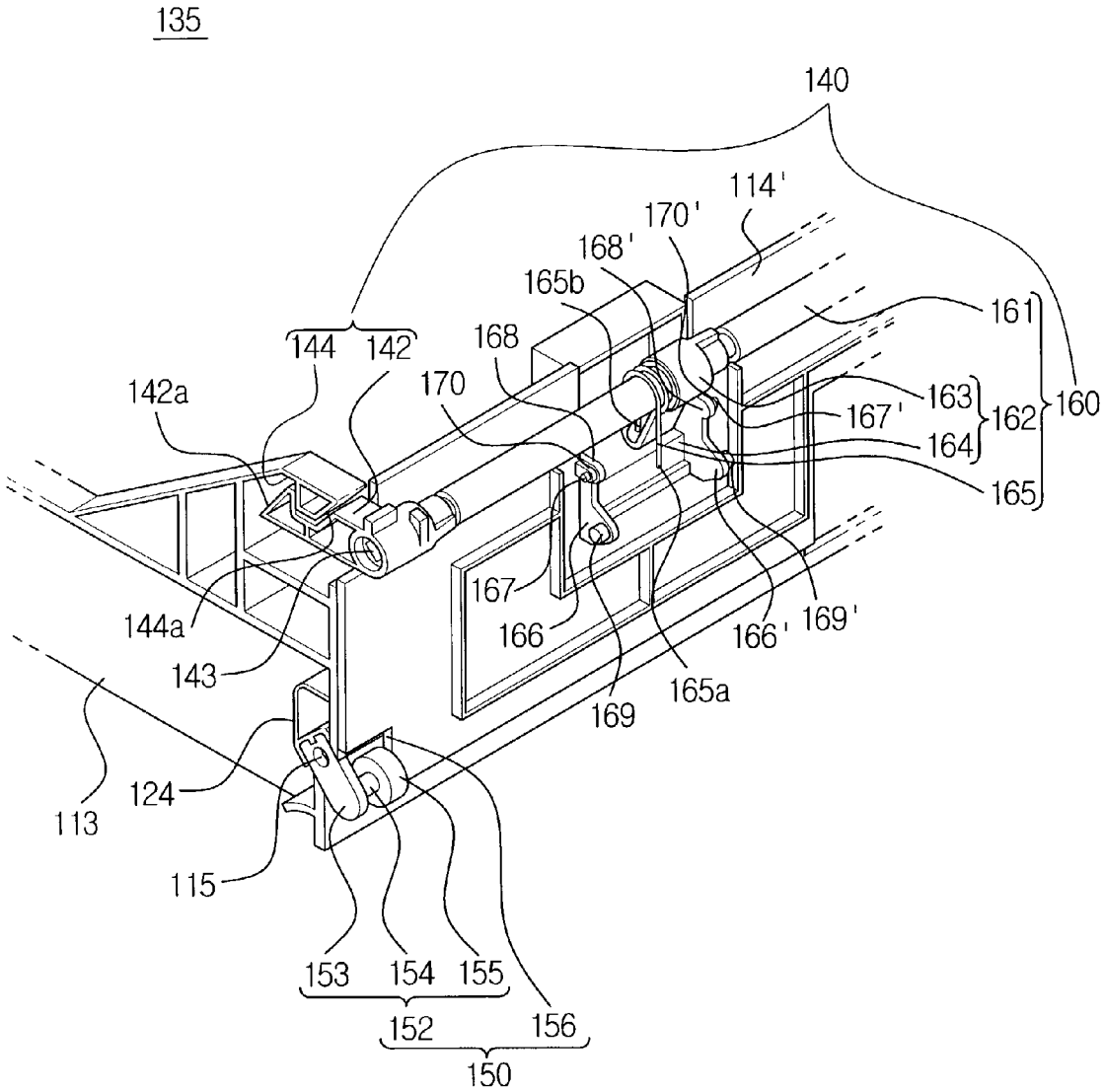
FIG. 4 is a perspective view of a loading size adjustment mechanism of the paper feeding cassette shown in FIG. 2.

As shown in FIG. 4, in more detail, the hook member actuating part 160 includes a supporting member 161 to pivotally support the hook members 142 and 142' on the end wall 114, so that the hook members 142 and 142' are moved between a locking position (FIGS. 3 and 4), in which the hook members 142 and 142' are locked in the hook member locking grooves 144 and 144' and a releasing position (FIG. 2) in which the hook members 142 and 142' are released from the hook member locking grooves 144 144'. The hook member actuating part 160 also includes an actuating member 162 to actuate the supporting member 161 to allow the hook members 142 and 142' to be moved to the releasing position, and a return member 165 to elastically urge the actuating member 162 to allow the hook members 142 and 142' to be returned to the locking position.

The supporting member 161 includes a shaft which pivotally supports the hook members 142 and 142' on the end wall 114, so that the hook members 142 and 142' move between the locking position and the releasing position. The shaft is supported on a supporting bracket (not shown) formed on the rear plate 114", and opposite ends thereof are inserted and fixed into fixing holes 143 of the hook members 142 and 142'.

The actuating member 162 includes a projection lever 163 which radially projects from a center of the shaft of the supporting member 161, and an actuating button 164 which is provided on the end wall 114 and projects into a paper-receiving space of the paper feeding cassette 100. The actuating button 164 pushes the projection lever 163 to rotate the shaft of the supporting member 161 and thereby, to move the hook members 142 and 142' to the releasing position.

To push the projection lever 163, the actuating button 164 includes hinges 168 and 168' with shafts 167 and 167' thereof being hinged on hinge brackets 170 and 170' formed on the front plate 114' of the end wall 114 in a center portion between opposite side walls 166 and 166', and slide projections 169 and 169' formed on lower portions of the opposite side walls 166 and 166' to move along a slide guide (not shown) provided on the rear plate 114" of the end wall 114.

In addition, the return member 165 includes an elastic spring positioned so that one end 165*a* of the return member 165 is supported on the rear plate 114" and the other end 165*b* compresses the projection lever 163 to rotate the shaft of the supporting member 161 through the projection lever 163 and thereby, to return the hook members 142 and 142' to the locking position.

Therefore, if a user presses the actuating button 164, which projects into the paper receiving space of the paper feeding cassette 100 to rotate about the shafts 167 and 167' of the hinges 168 and 168' to release the hook members 142 and 142' from the hook member locking groves 144 and 144', the projection lever 163 which contacts the actuating button 164 rotates in a certain direction (for example, in a counterclockwise direction) while pushing the other end 165*b* of the elastic spring of the return member 165 and hence, the shaft of the supporting member 161 also rotates counterclockwise. As a result, the hook members 142 and 142' attached to the shaft of the supporting member 161 rotate counterclockwise and are released from the hook member locking grooves 144 and 144', allowing the end wall 114 to move to the horizontal position. That is, the end wall 114 is moved to the horizontal position to broaden the loading size in the lengthwise direction of the papers.

After the hook members 142 and 142' are released from the hook member locking grooves 144 and 144', the projection lever 163, the hook members 142 and 142' and the actuating button 164 are sequentially rotated clockwise and returned to their original positions by an elastic returning force of the other end 165*b* of the elastic spring of the return member 165.

The hinge parts 150 and 150' include hinge shaft members 152 and 152' provided in the lower portions of the opposite side walls 113 and 113' adjacent to the end wall 114, and receiving parts 156 and 156' formed in the lower portions of the opposite ends of the end wall 114 to rotatably support the hinge shaft members 152 and 152'.

Each of the hinge shaft members 152 and 152' includes a stationary bracket 153 fixed to a fixing boss 124 positioned on the lower portion of one of the opposite side walls 113 and 113', respectively, by a screw 115 and projected toward the lower portion of the end wall 114. Each of the hinge shaft members 152 and 152' includes a shaft 154 fixed on an end of the stationary bracket 153 and pivotally supports the lower portion of the end wall 114. The shaft 154 may include a roller 155 to allow the end wall 114 to smoothly rotate.

Each of the receiving parts 156 and 156' is provided to rotatably receive the shaft 154 and the roller 155 in a lower portion of the front plate 114' of the end wall 114. The receiving parts 156 and 156' may be formed as shaft receiving openings or holes.

As shown in FIGS. 2 and 3, the end wall 114 includes an auxiliary moving guide rail 108' which is coupled to a moving guide rail 108 formed on the bottom plate 111, so that the rear guide member 130 is moved onto the front plate 114' of the end wall 114 to guide and align the rear edges of the papers when the end wall 114 is pivoted to the horizontal position. The moving guide rail 108 includes a recess 134 formed on the bottom plate 111 to guide the movement of the rear guide member 130, and a guide hole 108 and a latch part or groove 132 formed on the recess 134, respectively to receive the second slide projection 129 and to lock the latch formed on the bottom part 133 of the rear guide member 130.

The auxiliary moving guide rail 108' includes a recess 134' formed on the front plate 114' to guide the movement of the rear guide member 130, and a latch part or a groove 132' formed in the recess 134' to lock with the latch formed on the bottom part 133 of the rear guide member 130.

Alternatively, the auxiliary moving guide rail 108' may include an auxiliary guide hole (not shown) which is connected to the guide hole 118 of the moving guide rail 108 formed on the bottom plate 111 to guide the second slide projection 129 formed on the bottom part 133 of the rear guide member 130.

According to the above, it is described that the loading size adjustment mechanism 135 of the present invention is applied to the end wall 114 to increase the lengthwise loading size of the paper sheets. However, the loading size adjustment mechanism 135 also may be applied to one or both of the opposite side walls 113 and 113' to increase the crosswise loading size of the papers by using the same construction.

An operation of the paper feeding cassette 100 of the present invention with reference to FIGS. 2 through 4 will be described below.

First, it is described how the end wall 114 is moved to the horizontal position to enlarge the lengthwise loading size to load, for example, Super-A3 size papers.

When the user compresses the actuating button 164, which projects into the paper receiving space of the paper feeding cassette 100, so that the actuating button 164 rotates about the shafts 167 and 167' of the hinges 168 and 168', the projection lever 163 which is in contact with the actuating button 164 rotates counterclockwise while pushing the other end 165*b* of the elastic spring of the return member 165.

As the projection lever 163 rotates counterclockwise, the shaft of the supporting member 161 connected to the projection lever 163 also rotates counterclockwise. As a result, the hook members 142 and 142' connected to the shaft 161 rotate counterclockwise, thereby being released from the locking grooves 144 and 144'. At this time, if the user pushes the end wall 114 outwardly together with the actuating button 164, the end wall 114 is moved to the horizontal position by the hinge shaft members 152 and 152' which are supported in the shaft receiving parts 156 and 156'.

After the hook members 142 and 142' are released from the hook member locking groves 144 and 144', the projection lever 163, the hook members 142 and 142' and the actuating button 164 are sequentially rotated and returned to their original positions by the elastic returning force of the other end of the elastic spring of the return member 165.

Thereafter, in order to guide and align the rear edge of the papers, the rear guide member 130 moves from the moving guide rail 108 formed on the bottom plate 111 to the auxiliary moving guide rail 108' formed on the front plate 114' of the end wall 114.

As the rear guide member 130 keeps moving on the auxiliary moving guide rail 108', the latch formed on the bottom part 133 of the guide member 130 is engaged with the groove 132', and then the Super-A3 papers are loaded and printing proceeds.

If papers exceeding the Super-A3 size are required to be loaded in the paper feeding cassette 100, the papers are loaded after the rear guide member 130 is moved to an extent that the papers are received in the lengthwise direction thereof, and then the rear guide member 130 is moved to contact with the rear edges of the papers. Thereafter, the printing may proceed.

Next, it is described how the paper loading size is returned to an original state. First, the Super-A3 papers in use are removed and the rear guide member 130 is moved from the auxiliary moving guide rail 108' on the end wall 114 to the moving guide rail 108 on the bottom plate 111.

Then, when the end wall 114 is rotated about the hinge shaft members 152 and 152', each being moved in the shaft receiving parts 156 and 156' to the vertical position, an inclined end 142*a* of each of the hook members 142 and 142' rotates counterclockwise to a height of an inclined surface 144*a* formed at entrances of the hook member locking grooves 144 and 144' while being engaged with the inclined surface 144*a*. At this time, a rotating force of the hook members 142 and 142' is transferred to the elastic spring of the return member 165 through the shaft of the supporting member 161 connected to the hook members 142 and 142' and the projection lever 163, pressing the elastic spring of the return member 165.

Thereafter, if the end wall 114 continues to rotate to the vertical position, the hook members 142 and 142' are positioned to be inserted into the hook member locking grooves 144 and 144' and thus, the elastic spring of the return member 165 compressed by the hook members 144 and 144' exerts an elastic returning force to the projection lever 163, so that the shaft of the supporting member 161 rotates to its original position. As a result, the hook members 142 and 142' are locked into the hook member locking grooves 144 and 144', retaining the end wall 114 in the vertical position.

As described above, the paper feeding cassette according to the present invention is configured such that various sizes of papers may be used without having to increase a size of the cassette and an office machine which uses the cassette, by providing a loading size adjustment mechanism which is capable of varying the paper loading size of the paper feeding cassette in accordance with the sizes of the papers to be used.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A paper feeding cassette to load papers, comprising:

a frame provided with a bottom plate to support the papers, and a plurality of walls to define a paper loading size;

a plurality of loading size adjustment device to pivotally connect at least one of the walls to be hinged on said bottom plate, so that said at least one wall is movable between a vertical position to limit the paper loading size and a horizontal position to not limit the paper loading size, enabling a variation of the paper loading size above a predetermined size; and a guide member selectively moveable between said bottom plate when said at least one wall is in the vertical position and said at least one wall when said at least one wall is in the horizontal position.

2. The paper feeding cassette according to claim 1, wherein the loading size adjustment device comprises:

at least one locking part to lock said at least one wall in the vertical position when said at least one wall is moved to the vertical position; and at least one hinge part to movably support said at least one wall, so that said at least one wall is pivoted between said vertical position and said horizontal position.

3. A paper feeding cassette to load papers, comprising:

a frame provided with a bottom plate to support the papers, and a plurality of walls to define a paper loading size; and a loading size adjustment device to pivotally connect at least one of the walls to be hinged on said bottom plate, so that said at least one wall is movable between a vertical position to limit the paper loading size and a horizontal position to not limit the paper loading size, enabling a variation of the paper loading size above a predetermined size, wherein the loading size adjustment device comprises:

at least one locking part to lock said at least one wall in the vertical position when said at least one wall is moved to the vertical position; and at least one hinge part to movably support said at least one wall, so that said at least one wall is pivoted between said vertical position and said horizontal position, and wherein said locking part comprises:

at least one hook member formed on at least one of one end and the other end of a portion of said at least one wall;

at least one hook member locking groove formed on at least one of portions of neighboring walls positioned adjacent to said at least one wall to correspond to said hook member; and a hook member actuating part to lock said hook member in said hook member locking groove and to release said hook member from said locking groove.

4. The paper feeding cassette according to claim 3, wherein said hook member actuating part comprises:

a supporting member to pivotally support the hook member on the at least one wall so that the hook member is moved between a locking position to lock said hook member in said hook member locking groove, and a releasing position to release said hook member from said hook member locking groove;

an actuating member to actuate said supporting member to allow said hook member to be moved to said releasing position; and a return member to elastically urge said actuating member to allow said hook member to be returned to said locking position.

5. The paper feeding cassette according to claim 4, wherein said supporting member comprises:

a shaft to pivotally support the hook member on said at least one wall so that said hook member moves between said locking position and said releasing position.

6. The paper feeding cassette according to claim 5, wherein said actuating member comprises:

a projection part provided on said shaft to radially project from a center of the shaft; and an actuating button provided on said at least one wall, so that said actuating button comes into contact with said projection part to move said hook member to said releasing position.

7. The paper feeding cassette according to claim 6, wherein said return member comprises:

an elastic spring positioned to elastically compress said projection part to rotate said shaft of the supporting member through said projection part, so that said hook member is returned to said locking position.

8. The paper feeding cassette according to claim 7, wherein the hinge part comprises:

at least one hinge shaft member provided in at least one of other portions of the neighboring walls positioned adjacent to said at least one wall, so that the at least one wall is rotated about the hinge shaft member; and at least one receiving part formed in at least one of one end and the other end of other portions of said at least one wall to rotatably support said hinge shaft member.

9. The paper feeding cassette according to claim 8, wherein said hinge shaft member comprises:

a stationary bracket fixed on the other portion of said at least one of the neighboring walls to project toward the other portion of said at least one wall; and a shaft fixed on an end of said stationary bracket to pivotally support the other portion of said at least one wall.

10. The paper feeding cassette according to claim 9, wherein said shaft comprises a roller so that the at least one wall is smoothly rotated.

11. The paper feeding cassette according to claim 9, wherein said receiving part comprises:

a shaft receiving groove to rotatably receive said shaft in the other portion of said at least one wall.

12. The paper feeding cassette according to claim 11, wherein said at least one wall is an end wall which defines a lengthwise loading size of the papers and said neighboring walls are side walls which define a crosswise loading size of the papers.

13. The paper feeding cassette according to claim 12, further comprising:

a rear guide member to guide and align rear edges of the papers; and an auxiliary moving guide rail provided on the end wall which is connected to a moving guide rail formed on said bottom plate, so that said rear guide member is moved onto said end wall when said end wall is pivoted to the horizontal position.

14. The paper feeding cassette according to claim 5, wherein the shaft of the supporting member is supported on a supporting bracket formed on the at least one wall, and at least one end of the shaft is inserted and fixed into a fixing hole of the hook member.

15. The paper feeding cassette according to claim 6, wherein the actuating button projects into a paper receiving space of the paper feeding cassette, and further pushes the projecting part to rotate the shaft of the supporting member to move the hook member to the releasing position.

16. The paper feeding cassette according to claim 7, wherein the elastic spring is positioned so that one end thereof is supported on a rear plate of the at least one wall and the other end of the elastic spring compresses the projection part to rotate the shaft through the projection part, so that the hook member is returned to the locking position.

17. The paper feeding cassette according to claim 7, further comprising:

a hinge bracket formed on a front plate of the at least one wall between opposite side walls in a center portion of the at least one wall, wherein the actuating button includes, at least one hinge having a shaft to be hinged on the hinge bracket to push the projection part, and at least one slide projection formed on portions of the opposite side walls to move along a slide guide provided on a rear plate of the at least one wall.

18. The paper feeding cassette according to claim 17, wherein the actuating button is pushed to rotate about the at least one hinge thereof to release the hook member from the hook member locking groove.

19. The paper feeding cassette according to claim 18, wherein when the actuating button is pushed to rotate about the at least one hinge thereof, the projection part which contacts the actuation button rotates in a first direction while pushing the other end of the elastic spring, allowing the shaft of the supporting member to rotate in the first direction.

20. The paper feeding cassette according to claim 19, wherein the hook member is attached to the shaft of the supporting member and rotates in the first direction to be released from the hook member locking groove, allowing the at least one wall to move to the horizontal position.

21. The paper feeding cassette according to claim 20, wherein after the hook member is released from the hook member locking groove, the projection part, the hook member, and the actuating button are sequentially rotated in a second direction and returned to an ORIGINAL position thereof by an elastic returning force of the other end of the elastic spring.

22. The paper feeding cassette according to claim 11, wherein the receiving part is one of a shaft receiving opening and a shaft receiving hole.

23. The paper feeding cassette according to claim 13, wherein the rear guide member comprises:

a latch and a slide projection formed on a bottom surface of the rear guide member.

24. The paper feeding cassette according to claim 23, wherein the auxiliary moving guide rail comprises:

a recess formed on a front plate of the end wall to guide a movement of the rear guide member; and a latch part formed in the recess to lock with the latch formed on a bottom surface of the rear guide member.

25. The paper feeding cassette according to claim 23, wherein the auxiliary moving guide rail comprises:

an auxiliary guide hole connected to a guide hole of the moving guide rail formed on the bottom plate to guide the slide projection formed on a bottom surface of the rear guide member.

26. The paper feeding cassette according to claim 11, wherein when the at least one wall is rotated about the hinge shaft member to the vertical position, an inclined end of the hook member rotates in a first direction to a height of an inclined surface formed at an entrance of the hook member locking groove while being engaged with the inclined surface.

27. The paper feeding cassette according to claim 26, wherein a rotating force of the hook member is transferred to the elastic spring of the return member through the shaft of the supporting member to press the elastic spring of the return member.

28. The paper feeding cassette according to claim 27, wherein when the at least one wall is rotated to the vertical position the hook member is positioned to be inserted into the hook member locking groove, allowing the elastic spring to exert an elastic returning force to the projection part so that the shaft of the supporting member rotates to an ORIGINAL position.

* * * * *

UNITED STATES PATENT AND TRADEMARK OFFICE

CERTIFICATE OF CORRECTION

PATENT NO. : 7,097,172 B2
APPLICATION NO. : 10/430255
DATED : August 29, 2006
INVENTOR(S) : Won-kil Chang It is certified that error appears in the above-identified patent and that said Letters Patent is hereby corrected as shown below:

Column 11, Line 10, change “ORIGINAL” to --original--.

Column 12, Line 25, change “ORIGINAL” to --original--.

Signed and Sealed this

Thirtieth Day of January, 2007

JON W. DUDAS
*Director of the United States Patent and Trademark Office*